US005842606A

United States Patent [19]

DeVito

[11] Patent Number: 5,842,606

[45] Date of Patent: Dec. 1, 1998

[54] BEVERAGE SERVER

[76] Inventor: Joseph A DeVito, 2141 Willow St., Wantagh, N.Y. 11793

[21] Appl. No.: 940,882

[22] Filed: Sep. 30, 1997

[51] Int. Cl.[6] ..... B67D 5/60

[52] U.S. Cl. ..... 222/132; 222/143; 222/185.1; 222/368; 222/509

[58] Field of Search ..... 222/129, 132, 222/143, 185.1, 368, 410, 509

[56] References Cited

U.S. PATENT DOCUMENTS

| | | | |
|---|---|---|---|
| 710,949 | 10/1902 | Calley | 222/132 X |
| 1,296,172 | 3/1919 | Drewes | 222/132 X |
| 2,058,027 | 10/1936 | Martinet | 222/185.1 X |
| 3,589,566 | 6/1971 | Rivest et al. | 222/132 |
| 3,782,602 | 1/1974 | Page | 222/143 |
| 3,814,293 | 6/1974 | Daves | 222/185.1 X |
| 3,933,275 | 1/1976 | Metzner et al. | 222/185.1 X |
| 4,143,795 | 3/1979 | Casebier | 222/143 |
| 4,162,029 | 7/1979 | Gottsegen et al. | 222/143 X |
| 4,844,290 | 7/1989 | McCurdy et al. | 222/185.1 |
| 4,911,334 | 3/1990 | Kedzierski | 222/185.1 X |
| 4,928,855 | 5/1990 | Ramsey | 222/185.1 X |
| 5,104,003 | 4/1992 | Stecoza | 222/185.1 X |
| 5,222,631 | 6/1993 | Hood | 222/185.1 X |
| 5,335,829 | 8/1994 | Sovann | 222/185.1 X |
| 5,377,878 | 1/1995 | Rainey et al. | 222/185.1 X |
| 5,444,992 | 8/1995 | Bell | 222/146.6 X |
| 5,460,298 | 10/1995 | DiBiase et al. | 222/173 |
| 5,524,795 | 6/1996 | Lee | 222/207 |
| 5,564,597 | 10/1996 | Koorse et al. | 222/185.1 X |

*Primary Examiner*—Kevin P. Shaver
*Attorney, Agent, or Firm*—Michael I. Kroll

[57] ABSTRACT

A beverage server (10) for providing a variety of beverage choices to a user comprises a plurality of dispenser sections (12) connected together. Each of the plurality of dispenser sections (12) include first and second vertical walls (14, 16) and at least one horizontal shelf (18 or 20) connected therebetween. The first wall (14) includes a length, at least one clip (36) extending therefrom and a shelf guide (22 and 24) extending along the length on a side opposite the at least one clip (36). The second side (16) has a length, at least one recess (38) extending therethrough and a shelf guide (22 and 24) extending along the length, the shelf guide (22 and 24) on the second side wall (16) is positioned to face the shelf guide (22 and 24) on the first side wall (14). The at least one shelf (18 or 20) includes a recess (30 or 32) extending therethrough and is seated within said shelf guides (22 and 24) of both the first and second side walls (14 and 16). A dispenser (34) including a bottle (50) and a nozzle (52) attached thereto is positioned in an inverted direction to extend through the recess (30 or 32) in the at least one shelf (18 or 20), wherein the at least one recess (38) on the second side wall (16) of the dispensing section (12) is aligned to receive and releasably mate with the at least one clip (36) on the first side (14) of an adjacent one of the plurality of dispensing sections (12).

14 Claims, 5 Drawing Sheets

Fig. 6
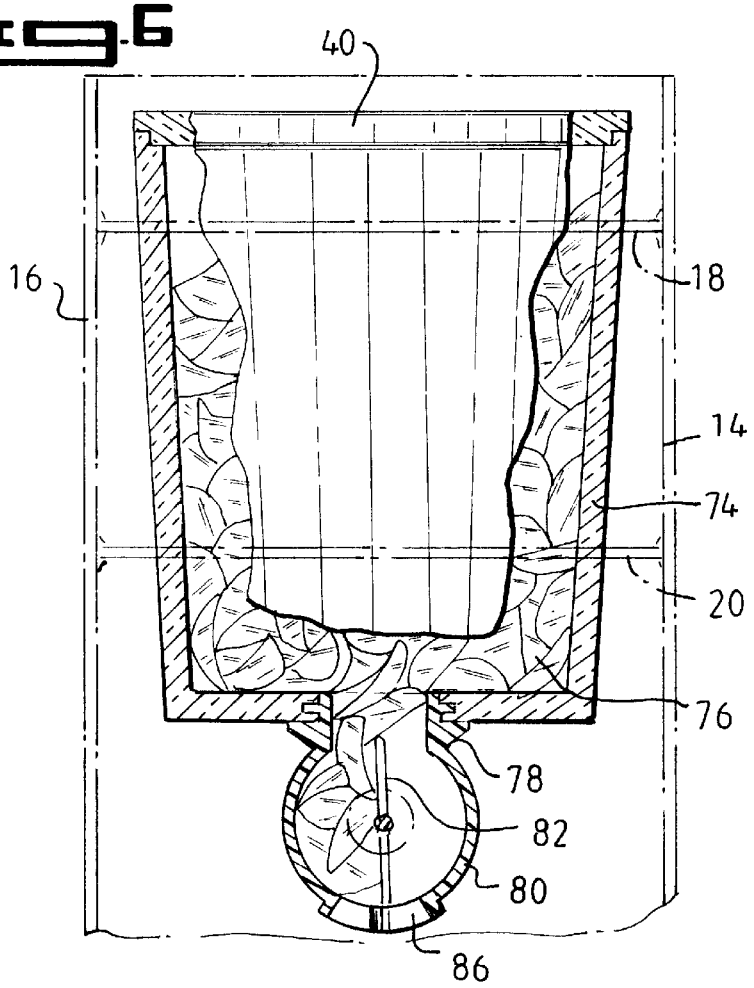
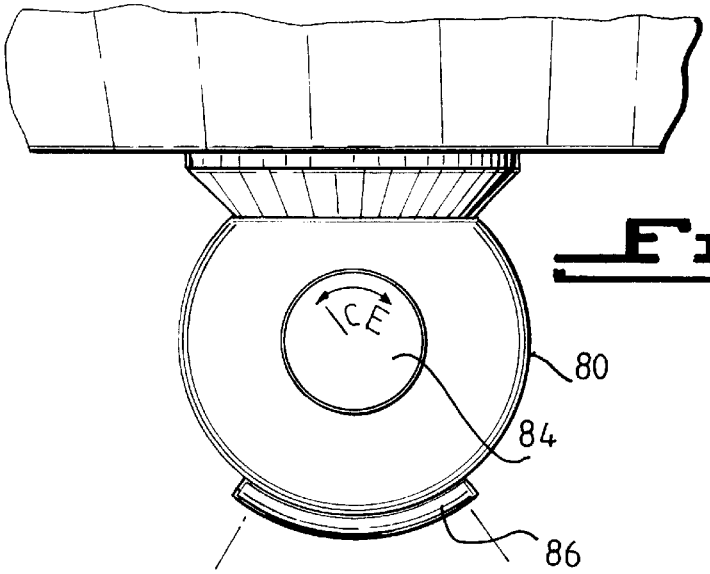
Fig. 7

BEVERAGE SERVER

BACKGROUND OF THE INVENTION

1. Field of the Invention

The instant invention relates generally to drink serving devices and, more specifically, to a beverage server able to provide a user with a desired number of drink selections.

2. Description of the Prior Art

Numerous drink serving devices have been provided in the prior art For example, U.S. Pat. Nos. 3,814,293; 5,444,992; 5,460,298 and 5,524,795 all are illustrative of such prior art. While these units may be suitable for the particular purpose to which they address, they would not be as suitable for the purposes of the present invention as heretofore described.

A dispensing rack and valve assembly for use with quart or king-size bottles of beverages. The rack supports a bottle in an inclined position and is suited to be placed on a shelf in a conventional refrigerator. The dispensing valve has a threaded portion to engage the threaded mouth of a conventional bottle of carbonated beverage. The valve assembly cooperates with the rack to secure the bottle in place.

This invention disclosure pertains to a device which is used for cooling soda and food by means of a reusable two piece horizontally positioned iceblock pack which the parts thereof are molded to conform to the shape of a two liter soda bottle. The iceblock pack with bottle and a food holding tray are contained within a thickly insulated rectangular housing. A vented tap is screwed onto the bottle after being enclosed within the case to permit dispensing of the soda. The unit is supported into its tilted angled down position by means of an angular shaped leg apparatus which is also the carrying handle apparatus when rotated around to the top of the cooling unit and snapped onto the spring loaded buttons. The iceblock packs contained within the cooler are to be frozen within a freezing unit before usage.

A stand for container inversion is provided to allow for prompt, efficient, and full dispensing of viscous material from their containers. A cup-shaped stand is interposed between a bottle and its cap, the stand defining a support surface to allow the container to be maintained in an inverted posture. The stand may be an integral portion of the bottle or of the cap, or it may be a separate entity altogether. Additionally, the stand may be configured such as to nestingly receive the bottom of the container or bottle when implementation of the stand is not desired.

A dispensing unit for a threaded neck bottle including a dispensing nipple, valve assembly, and a connector. The dispensing nipple is squeezable and mostly cylindrical in shape with one end converging. The bottom of the converging end is open so that the fluid contained within the dispensing nipple escapes when the nipple is squeezed. The valve arrangement is disposed inside the convergent end of the dispensing nipple and includes a rod connecting a ball valve at its bottom and a truncated cone shaped member at its other end. The connector secures the neck of the storage bottle to the dispensing nipple and includes outer and inner concentric cylinders secured to and made an integral part of an annular ring having an outside diameter and an inside diameter about the same diameter as the first and second concentric cylinders. The annular ring seals one end of the space between the cylinders. The inside of the outer cylinder is provided with threads for threadably receiving the top of the dispensing nipple into the side of the connector away from the annular ring. The inside of the inner cylinder is provided with internal threads to threadably receive the threaded neck of the storage bottle inserted from the side of the annular ring away from the concentric cylinders. The lower end of the internal concentric cylinder is provided with a seat which mates with the truncated cone shaped member within the dispensing nipple to seat when the condiment bottle is inverted.

SUMMARY OF THE PRESENT INVENTION

The instant invention relates generally to drink serving devices and, more specifically, to a beverage server able to provide a user with a desired number of drink selections.

A primary object of the present invention is to provide a beverage server that will overcome the shortcomings of prior art devices.

Another object of the present invention is to provide a beverage server able to accommodate a plurality of drink dispensers thus providing a user a variety of beverages from which to choose.

An additional object of the present invention is to provide a beverage server including an insulated ice bucket for serving ice cubes for use in cooling the drink of a user.

A further object of the present invention is to provide a beverage server which eliminates waste of any product within the dispensers.

A yet further object of the present invention is to provide a beverage server including a plurality of interlocking sections for holding a desired number of soft drink selections.

A still further object of the present invention is to provide a beverage server which keeps carbonated drinks from going flat without the need for the bottle caps.

An even further object of the present invention is to provide a beverage server including leak proof nozzles on each dispenser to prevent spills.

Another object of the present invention is to provide a beverage server that is simple and easy to use.

A still further object of the present invention is to provide a beverage server that is economical in cost to manufacture.

Additional objects of the present invention will appear as the description proceeds.

A beverage server for providing a variety of beverage choices to a user comprises a plurality of dispenser sections connected together is disclosed by the present invention. Each of the plurality of dispenser sections include first and second vertical walls and at least one horizontal shelf connected therebetween. The first wall includes a length, at least one clip extending therefrom and a shelf guide extending along the length on a side opposite the at least one clip. The second side has a length, at least one recess extending therethrough and a shelf guide extending along the length, the shelf guide on the second side wall is positioned to face the shelf guide on the first side wall. The at least one shelf includes a recess extending therethrough and is seated within said shelf guides of both the first and second side walls. A dispenser including a bottle and a nozzle attached thereto is positioned in an inverted direction to extend through the recess in the at least one shelf, wherein the at least one recess on the second side wall of the dispensing section is aligned to receive and releasably mate with the at least one clip on the first side of an adjacent one of the plurality of dispensing sections.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 6 is a cross-sectional side view of an ice dispenser used with the beverage server of the present invention;

FIG. 7 is a side view of the dispensing mechanism of the ice dispenser used with the beverage server of the present invention.

DESCRIPTION OF THE REFERENCED NUMERALS

Figure 1:
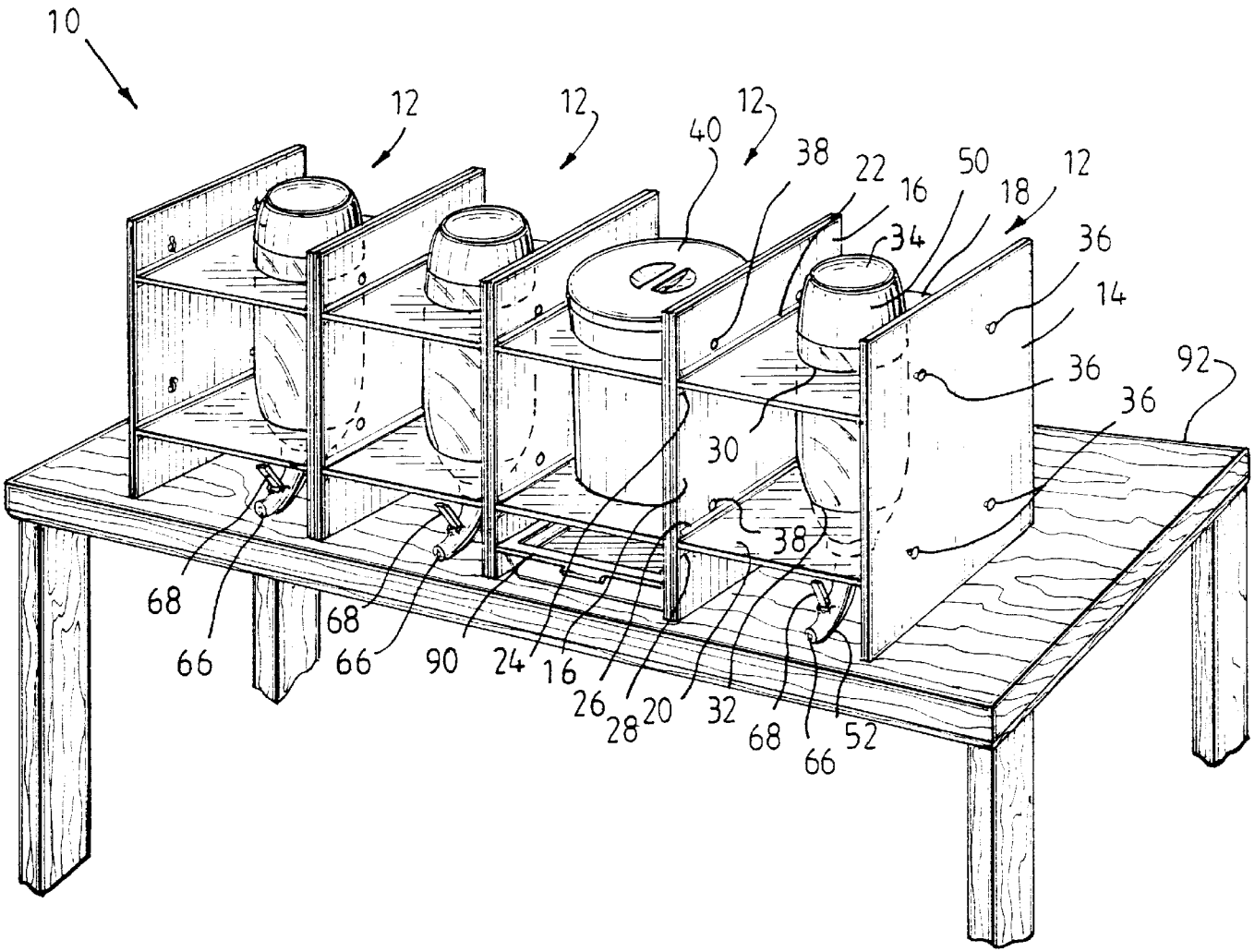
FIG. 1 is a front perspective view of the beverage server of the present invention.
Figure 2:
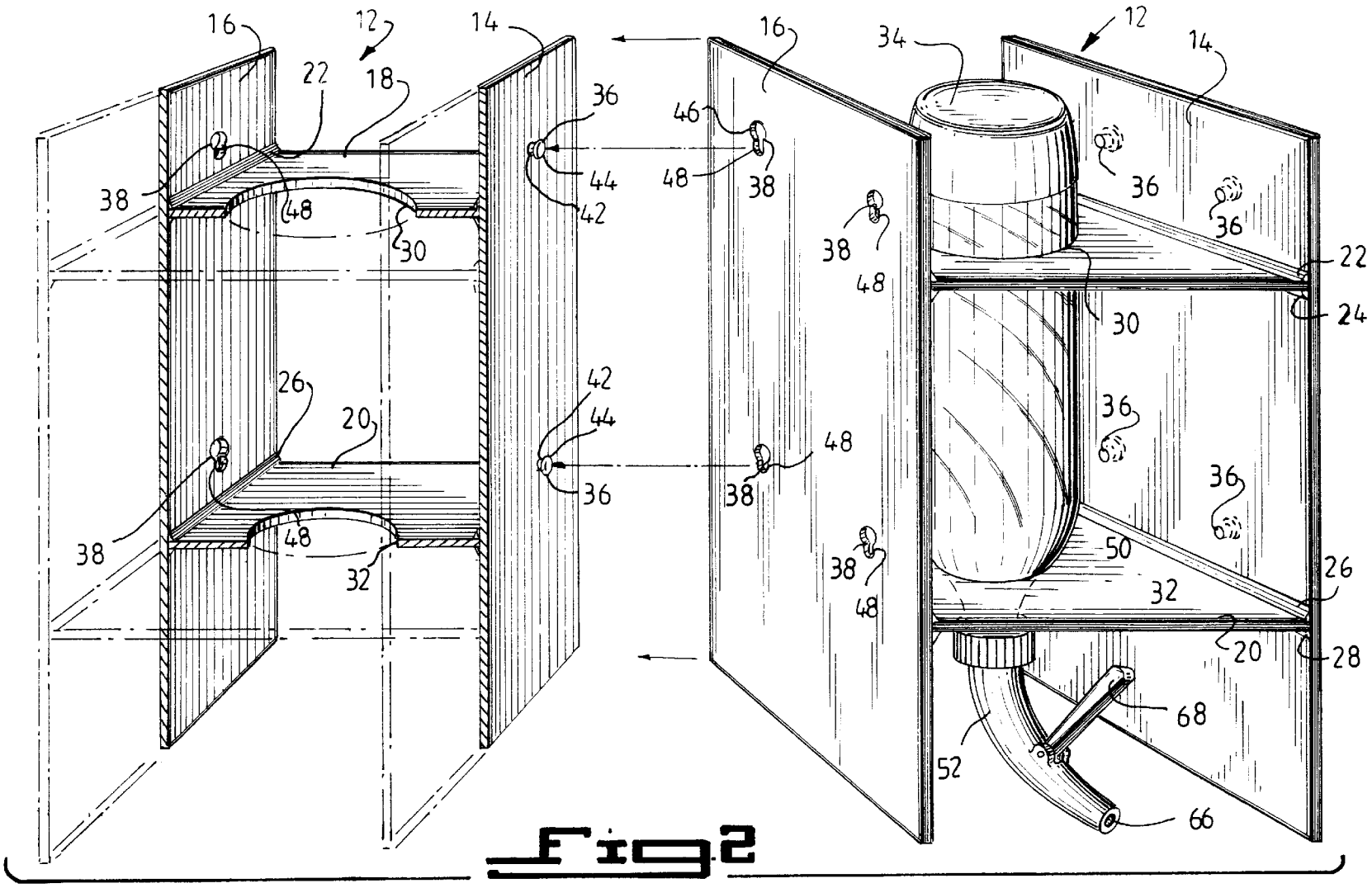
FIG. 2 is an exploded view in partial cross-section of the beverage server of the present invention.

Turning now descriptively to the drawings, in which similar reference characters denote similar elements throughout the several views, the Figures illustrate a beverage server of the present invention. With regard to the reference numerals used, the following numbering is used throughout the various drawing figures

10 beverage server of the present invention
12 dispensing section of the beverage server
14 left side vertical wall
16 right side vertical wall
18 upper horizontal shelf
20 lower horizontal shelf
22 top shelf guide of first shelf guide pair for upper horizontal shelf
24 bottom shelf guide of first shelf guide pair for upper horizontal shelf
26 top shelf guide of second shelf guide pair for lower horizontal shelf
28 bottom shelf guide of second shelf guide pair for lower horizontal shelf
30 recess in upper horizontal shelf
32 recess in lower horizontal shelf
34 beverage dispenser
36 plurality of clips extending from right side vertical wall
38 plurality of recesses in left side vertical wall
40 ice chest
42 neck portion of clip
44 enlarged head portion of clip
46 receiving section of recess
48 engaging section of recess
50 bottle
52 nozzle of beverage dispenser
54 neck of bottle
56 thread spiraling around neck of bottle
58 neck of nozzle
60 inner side of neck of nozzle
62 thread spiraling around inner side of neck of nozzle
64 seal within neck of nozzle
66 dispensing end of nozzle
68 pivotable lever
70 stopper
72 inner wall of nozzle
74 body of ice chest
76 ice within ice chest
78 opening in base of body
80 dispenser regulating device
82 flow regulator
84 rotatable dial
86 dispenser opening
88 spout
90 drip tray
92 flat surface

DETAILED DESCRIPTION OF THE PREFERRED EMBODIMENT

Turning now descriptively to the drawings, in which similar reference characters denote similar elements throughout the several views, FIGS. 1 through 8 illustrate a beverage server indicated generally by the numeral 10.

The beverage server 10 includes at least one dispensing section 12. Each dispensing section 12 includes a right side vertical wall 14 and a left side vertical wall 16 extending parallel to each other. The left side vertical wall 14 is separated from the right side vertical wall 16 by an upper horizontal shelf 18 and a lower horizontal shelf 20. A first pair of shelf guides 22, 24 extends horizontally along both the right and left side vertical walls 14, 16 for securing the upper horizontal shelf 18 between the first and second vertical walls 14 and 16. A second pair of shelf guides 26, 28 extends horizontally along both the right and left side vertical walls 14, 16 for securing the lower horizontal shelf 20 between the first and second vertical walls 14 and 16. The upper and lower horizontal shelves 18 and 20 each include a recess 30 and 32, respectively, extending therethrough for receiving a drink dispenser 34 therein. The dimensions of the recess within each section will vary to accommodate dispensers of various size such as a one, two or three liter bottle or even an ice chest or cooler 40. Thus, when a section 12 of the beverage server 10 is being constructed, the user will be provided with a plurality of options regarding the dimensions of the recess and upper and lower horizontal shelves having a recess able to accommodate a desired size dispenser will be chosen.

The right side wall 12 includes at least one clip 36 extending therefrom and directed away from the left side wall 14. The left side wall 14 includes at least one recess 38 extending therethrough and aligned with the clip 36 on the right side wall 12. The at least one recess 38 is sized to receive the at least one clip 36 of the left side vertical wall 14 of an adjacent dispensing section 12 when combining dispensing sections 12 together. The interconnection of adjacent sections is clearly illustrated in FIG. 2. From this figure it is shown that the plurality of clips 36 extending from the right side vertical wall 14 are aligned with and sized to extend through the plurality of recesses 38 extending through the left side vertical wall 16. The clips 36 each include a neck portion 42 connected to the right side vertical wall 14 and an enlarged head portion 44 connected to the neck portion 42. Each of the recesses 38 include a receiving section 46 having a diameter large enough to receive the enlarged head portion 44 of a respective clip 36 and an engaging section 48 connected to and having a smaller diameter than the receiving section 46. The engaging section 48 is of a size large enough to receive and provide a snug engagement with the neck portion 42 of a respective clip 36. It is to be realized that the connection of the clips 36 to the right side vertical wall 14 and the recesses 38 in the left side vertical wall 16 are for purposes of description and not meant to limit the present invention in any manner. In practice the clips 36 may be connected to extend from the left side vertical wall 16 and the recesses 38 may extend through the right side vertical wall 14 without affecting the operation of the invention. This is a design choice to be made by the manufacturer.

Figure 3:
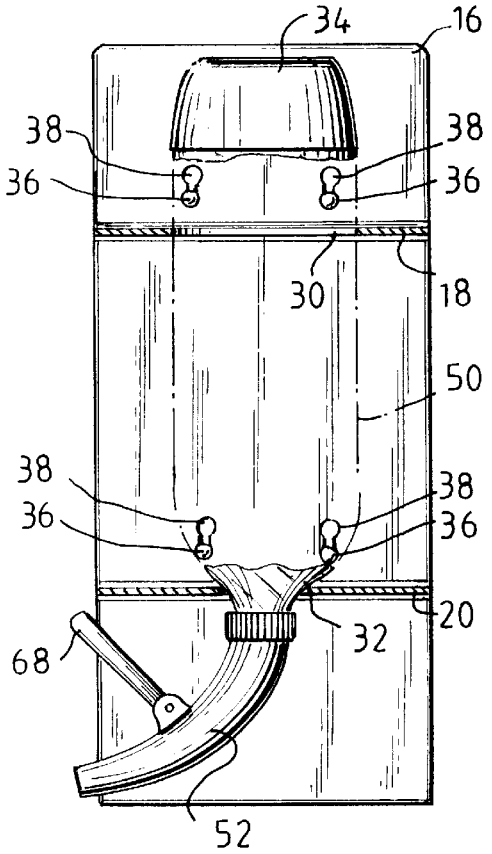
FIG. 3 is a side view of a single compartment of the beverage server of the present invention including a drink dispenser.
Figure 4:
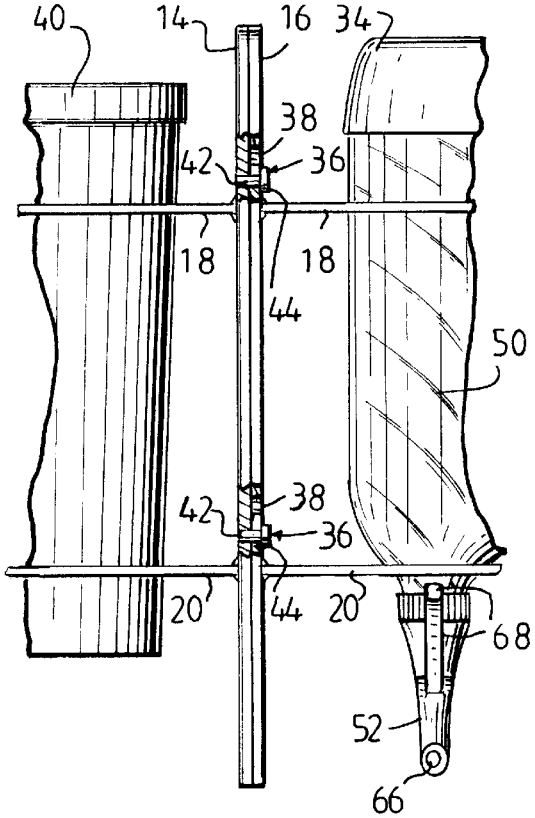
FIG. 4 is a side view of the connection between two compartments of the beverage server of the present invention.
Figure 5:
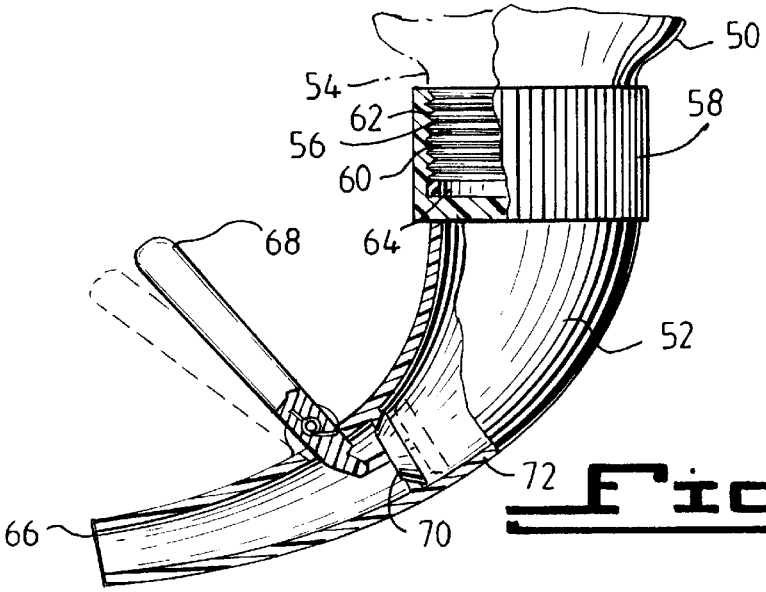
FIG. 5 is a side view in partial cross-section of a beverage dispensing nozzle of the beverage server of the present invention.

FIGS. 3 through 5 illustrate the beverage dispenser 34 used with the present invention in more detail. The beverage dispenser 34 includes a bottle 50 for retaining the beverage to be dispensed and a nozzle 52 connected thereto. The bottle 50 may be any bottle in which the beverage was originally packaged or any other bottle which is able to retain the beverage therein while being able to mate with the nozzle 52 so as to prevent leakage of the beverage and be held within the recesses 30 and 32 of the upper and lower horizontal shelves 18 and 20.

The bottle 50 includes a cylindrical neck portion 54 including an outer surface having a thread 56 spiraling therearound. The nozzle 52 also includes a cylindrical neck portion 58 including an inner surface 60 having a thread 62 spiraling therearound. The thread 56 is sized to mate with the thread 62 to connect the bottle 50 and nozzle 52 together in a spill proof manner. A seal 64 is positioned within the neck 58 of the nozzle 52 on a side of the thread 62 opposite the entrance for the bottle 50 to provide additional protection against leakage. The seal 64 is formed from any one of a soft rubber or polymeric material which is able to engage the neck of the bottle 50 and prevent the beverage contained within the bottle 50 from entering the area between the threaded engagement of the bottle 50 and nozzle 52. This aids in the prevention of leakage from the dispenser.

The nozzle 52 is wider at its connection with the bottle 50 and becomes increasingly more narrow towards its dispensing end 66 to provide a natural increase in the pressure at which the beverage exits the nozzle 52. A lever 68 is pivotably connected at a point between the connection with the bottle 50 and the dispensing end 66. The nozzle lever 68 is connected to a stopper 70 positioned within the nozzle 52 and sized to fit snuggly and releasably mate with an internal wall 72 of the nozzle 52 when the lever 68 is in its closed position. When the lever 68 is pivoted towards the dispensing end 66 the stopper 70 is forced towards the connection with the bottle 50 and due to the increasing diameter of the nozzle 52 a space is created between the stopper 70 and the inner wall 72 of the nozzle 52 allowing liquid beverage within the bottle to flow through the nozzle 52 and into a receptacle placed at the dispensing end 66 of the nozzle 52.

While a preferred structure for the nozzle 52 is shown and described herein, those of ordinary skill in the art who have read this description will appreciate that there are numerous other structures for the nozzle 52 and, therefore, the phrase "means for dispensing the beverage" should be construed as including all such structures as long as they achieve the desired result of dispensing the beverage, and therefore, that all such alternative mechanisms are to be considered as equivalent to the one described herein.

Figure 8:
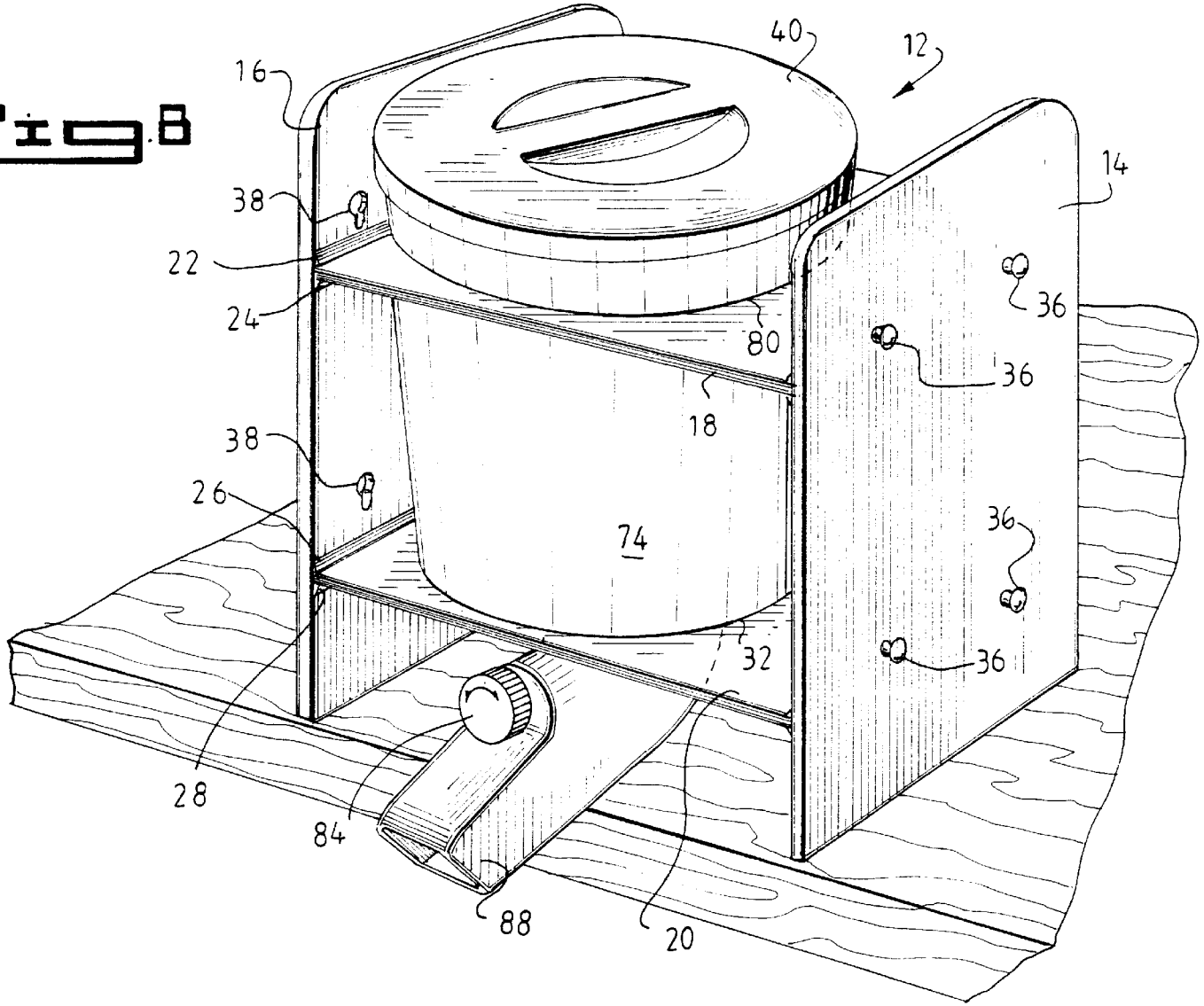
FIG. 8 is a side perspective view of the ice dispenser positioned within a section of the beverage server of the present invention.

An ice chest or cooler 40 for use with the beverage server 10 is illustrated in FIGS. 6 through 8. The ice chest 40 includes a large body 74 for holding the ice 76. The body 74 is preferably made of an insulating material which will prevent the ice from melting for a prolonged period of time in hot weather. At a base of the body 74 is an opening 78 for the dispensing of the ice 76. A dispenser regulating device 80 is provided at the opening 78 for regulating the flow of ice 76 out of the ice chest 40. The dispenser regulating device 80 is circular and includes a rotatable flow regulator 82 positioned therein. The flow regulator 82 is rotated by a dial 84 extending through an outer side of the dispenser regulating device 80. The length of the flow regulator 82 is substantially equal to the diameter of the dispenser regulating device 80. The ice is dispensed through an opening 86 in the base of the dispenser regulating device 80 when the dial 84 and thus the flow regulator 82 is rotated to provide access to the opening 86. The length of the flow regulator 82 allows the opening 86 to be blocked off when the dispensing of ice 76 is not desired thus retaining the ice 76 within the ice chest 40. As is depicted in FIG. 8,a spout 88 may be connected to the opening 86 below the dial 84 for providing easy access to receive the ice 76 being dispensed. Alternatively, a drip tray 90 as illustrated in FIG. 1 may be used to catch the ice 76 which is dispensed from the ice chest 40.

While a preferred structure for the ice chest 40 is shown and described herein, those of ordinary skill in the art who have read this description will appreciate that there are numerous other structures for the ice chest and, therefore, the phrase "means for retaining and dispensing ice" should be construed as including all such structures as long as they achieve the desired result of retaining and dispensing ice, and therefore, that all such alternative mechanisms are to be considered as equivalent to the one described herein.

The operation of the device and system will now be described. In operation, upper and lower horizontal shelves 18 and 20 each including a recess of a sufficient size to retain the desired beverage bottle are positioned within upper and lower pair of shelf guides 22, 24 and 26, 28 respectively of the right side vertical wall 14. The left side vertical wall 16 is then positioned to receive an opposing side of the upper and lower horizontal shelves 18 and 20 between its respective pair of upper and lower pairs of shelf guides 22, 24 and 26, 28 to form a single dispensing section 12. A desired number of dispensing sections 12 are then formed in an identical manner using upper and lower horizontal shelves having recesses of a size sufficient to retain a desired beverage bottle 50 or ice chest 40 therein.

A first constructed dispensing section 12 is then positioned atop a flat surface 92 such as a table whereby the upper and lower horizontal shelves 18 and 20 extend parallel and the right and left vertical walls 14 and 16 extend perpendicular to the flat surface 92. A second dispensing section 12 is placed adjacent to the first dispensing section 12 whereby the enlarged head portion 44 of the clips 36 extending from a vertical wall of the second dispensing section 12 are received by a respective receiving portion 46 of the recesses 38 in a wall of the first dispensing section 12. The neck portion 42 of the clips 36 are then received in the engaging portion 48 of their respective recesses 38 to thereby connect the two dispensing sections 12. Additional dispensing sections 12 are then connected as desired.

A cap covering the bottles 50 desired to be positioned within the beverage dispenser sections 12 are removed and a nozzle 52 is connected in its place by turning the nozzle 52 in a clockwise direction to engage the thread 56 on the neck 54 of the bottle 50 with the thread 62 spiraling around the inner side 60 of the neck 58 of the nozzle 52. The bottles 50 are then inverted and introduced nozzle 52 first through the respective recesses 30 and 32 in the upper and lower horizontal shelves 18 and 20. The bottles 50 are now in dispensing position within their respective dispensing section 12 of the beverage server 10. The ice chest 40 is also positioned within its respective dispensing section 12 nozzle 88 first through the respective recesses 30 and 32 in the upper and lower horizontal shelves 18 and 20 with a drip tray 90 positioned therebelow.

When it is desired to fill a receptacle with ice the dial 84 on the ice chest 40 is rotated thus turning the flow regulator 82 and allowing ice 76 to enter and pass through the dispenser regulating device 80, opening 86 and the spout 88. The ice 76 exits the spout 88 and enters the receptacle.

A beverage is dispensed by placing a receptacle at the opening 66 of the nozzle 52 and pivoting the lever 68 away from the bottle 50. This forces the stopper 70 further into the nozzle 52 and creates a passage for the liquid beverage to flow through. The beverage passes through the opening created by moving the stopper 70 and through the nozzle 52 into the receptacle. The lever 68 is then pivoted towards the bottle 50 to close the opening created by moving the stopper 70.

When all the beverage in a particular bottle 50 is dispensed the dispenser 34 is removed from its position in the dispensing section 12 by lifting it out in a direction opposite to the direction of entry. The nozzle 52 is removed by turning it in a counterclockwise direction to disengage the thread 56 on the neck 54 of the bottle 50 from the thread 62 spiraling around the inner side 60 of the neck 58 of the nozzle 52. The nozzle 52 may then be connected to a new bottle 50 and the new dispenser 34 inserted in the dispensing section 12 vacated by the removed dispenser 34. If there is still some beverage remaining within the removed dispenser 34, the bottle cap originally removed may be replaced and the bottle 50 place in a storage area such as a refrigerator.

From the above description it can be seen that the beverage server 10 of the present invention is able to overcome the shortcomings of prior art devices by providing a plurality of interlocking sections 12 for holding a desired number of beverages and thereby provide a user with a variety of beverages from which to choose along with an insulated ice bucket 40 for serving ice cubes 76 for use in cooling the drink of a user. The beverage server 10 eliminates waste of any product within the dispensers 34, prevent spills and keeps carbonated drinks from going flat without the need for the bottle caps via the use of a leak proof nozzle 52 on each drink dispenser 34 within the beverage server. Furthermore, the beverage server of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A beverage server for providing a variety of beverage choices to a user comprises a plurality of dispenser sections connected together in which each said dispenser section includes:

a) a first side wall having a length, a first shelf guide extending along said length and including at least one clip extending therefrom and positioned on a side of said first side wall opposite said first shelf guide;

b) a second side wall having a length, a second shelf guide extending along said length, and at least one recess extending therethrough, said shelf guide on said right side wall positioned to face said shelf guide on said left side wall;

c) a first shelf including a recess extending therethrough, positioned between said left and right side walls and removably seated within said first and second shelf guides; and d) a dispenser including a bottle and a nozzle attached thereto and positioned in an inverted direction to extend through said recess in said first shelf, wherein said at least one recess on said second side of said dispensing section is aligned to receive and releasably mate with said at least one clip on said first side of an adjacent one of said dispensing sections.

2. The beverage server as recited in claim 1, wherein said nozzle is cylindrical in shape and includes an inner side wall, a pivotable lever and a stopper connected to said lever and positioned within said nozzle, wherein said lever is pivotable between a first closed position maintaining said stopper in a position contacting said inner side wall and a second dispensing position in which said lever forces said stopper away from its position contacting said inner wall and providing a passage way for a beverage contained within said bottle to flow through and exit said dispenser.

3. The beverage server as recited in claim 1, wherein said first and side wall further includes a third shelf guide, said second side wall further includes a fourth shelf guide and each of said plurality of dispensing sections further include a second shelf including a recess extending therethrough for receiving said dispenser and positioned between said left and right side walls and received by said third and fourth shelf guides.

4. The beverage server as recited in claim 1, wherein said dispenser is an ice chest.

5. The beverage server as recited in claim 4, wherein said ice chest is formed of an insulating material for preventing ice contained therein from melting over an extended period of time.

6. The beverage server as recited in claim 4, wherein said ice chest includes an ice dispensing device for regulating an amount of ice dispensed from said ice chest.

7. The beverage server as recited in claim 1, wherein said ice chest includes a recess and said ice dispensing device includes a circular shell including a dispensing end and positioned to cover said opening, a flow regulator positioned within said circular shell and a rotatable dial connected to rotate said flow regulator between a position blocking ice from being dispensed through both said opening and dispensing end and a second position allowing a desired amount of ice to be dispensed through both said opening and dispensing end.

8. The beverage server as recited in claim 7, wherein said ice dispensing device farther includes a spout connected at said dispensing end for directing ice dispensed from said ice chest.

9. The beverage server as recited in claim 7, further comprising a drip tray positioned below said dispensing end for receiving ice dispensed from said ice chest.

10. The beverage server as recited in claim 1, wherein said bottle includes a neck portion having an outer side and a dispensing end and a thread spiraling around said outer side; and said nozzle includes a bottle receiving end including an inner side and a thread spiraling around said inner side, wherein said thread spiraling around said outer side of said neck of said bottle mates with said thread spiraling around said inner side of said inner side of said bottle receiving end.

11. The beverage server as recited in claim 1, wherein said at least one clip includes an enlarged head portion and a neck portion connected between said first side wall and said enlarged head portion and said at least one recess includes a clip receiving portion and a clip engaging section, wherein said enlarged head portion is received by said clip receiving portion and said neck portion is removably seated within said clip engaging section when adjacent dispensing sections are connected together.

12. The beverage server as recited in claim 1, wherein said plurality of dispensing sections are positioned on a flat horizontal surface such that said first and second side walls of each section extend perpendicular to said flat surface.

13. The beverage server as recited in claim 12, wherein said first shelf extends parallel to said flat surface and perpendicular to said first and second side walls.

14. The beverage server as recited in claim 3, wherein said plurality of dispensing sections are positioned on a flat horizontal surface such that said first and second side walls of each section extend perpendicular to said flat surface and said first and second shelves extend parallel to said flat surface and perpendicular to said first and second side walls.

* * * * *